United States Patent [19]

Davis

[11] 4,094,288

[45] June 13, 1978

[54] CARBURETOR FOR ENGINES USING DIESEL FUEL

[76] Inventor: William E. Davis, 762 Lindo La., Port St. Lucie, Fla. 33452

[21] Appl. No.: 642,053

[22] Filed: Dec. 18, 1975

[51] Int. Cl. ..... F02m 13/06

[52] U.S. Cl. ..... 123/127; 123/139 AW; 123/179 G; 261/52

[58] Field of Search ..... 123/127, 139 AW, 179.6, 123/298 D; 261/50 R, 52, DIG. 56, 63, 118

[56] References Cited

U.S. PATENT DOCUMENTS

| | | | |
|---|---|---|---|
| 890,970 | 6/1908 | Durr | 123/139 AW |
| 1,065,640 | 6/1913 | Thompson | 261/63 |
| 1,623,760 | 4/1927 | Sieber | 261/52 |
| 1,931,875 | 10/1933 | Oppenheim | 123/127 |
| 2,117,380 | 5/1938 | Walters | 123/139 AW |
| 2,136,959 | 11/1938 | Winfield | 123/139 AW |
| 2,182,090 | 12/1939 | Mallory | 261/52 |
| 2,218,699 | 10/1940 | Coffey | 261/52 |
| 2,294,847 | 9/1942 | Jeck | 261/52 |
| 2,415,435 | 2/1947 | Mallory | 261/52 |
| 2,759,468 | 8/1956 | Powell et al. | 123/139 AW |
| 2,884,918 | 5/1959 | Klug | 123/139 AW |
| 3,078,079 | 2/1963 | Mick | 261/63 |
| 3,182,976 | 5/1965 | LaForce | 261/63 |
| 3,509,589 | 5/1970 | Pantano | 123/139 AW |
| 3,510,112 | 5/1970 | Winquist et al. | 123/139 AW |
| 3,800,770 | 4/1974 | Baribeau et al. | 123/139 AW |
| 3,805,756 | 4/1974 | Madariaga | 123/127 |
| 3,807,377 | 4/1974 | Hirschler, Jr. et al. | 123/179 G |
| 3,831,909 | 8/1974 | Fveismuth | 261/63 |
| 3,937,194 | 2/1976 | Tamaki et al. | 123/198 D |

OTHER PUBLICATIONS

"Thermodynamics of Heat Power"—Virgil Moring Faries—pp. 138-151—The Macmillan Company (publisher), 1958.

*Primary Examiner*—Martin P. Schwadron
*Assistant Examiner*—G. L. Walton
*Attorney, Agent, or Firm*—Elizabeth Newton Dew

[57] ABSTRACT

A carburetor capable of replacing the conventional carburetor of a poppet-valve type internal combustion engine and making possible satisfactory operation thereof using ordinary diesel fuel atomized under high pressure. After a short warm-up period on regular gasoline, instantaneous switch-over to diesel fuel is made manually or automatically.

3 Claims, 7 Drawing Figures

FUEL
CONTROL
VALVE
40
42
38
37
36
29
34
35
2
9
4
4
22
21
23
24
23
20
22
14
31
40
5
1
14
4
4
9

3
3
3
12
1
33
14
14
34
29
9
15
9
18
M
3

SAFETY LINE TO TANK FROM PUMP
MAIN FUEL LINE TO PUMP
DIESEL FUEL
REGULAR GASOLINE
CONNECTED TO ACCELERATOR TREADLE

CARBURETOR FOR ENGINES USING DIESEL FUEL

SUMMARY OF THE INVENTION

This invention relates to carburetors and more particularly to carburetors which may be applied to existing internal combustion engines to adapt them to the satisfactory burning of diesel fuel. While such fuel is generally less expensive gallon for gallone, than regular grades of gasoline, it has not heretofore been practically possible to use it in conventional engines such as those used to propel motor vehicles and wherein combustion of the explosive mixture of fuel and air is effected by ignition systems including spark plugs.

One reason for the previously-existing problem in using diesel fuel is its greater viscosity and the difficulty of providing a carburetor which is capable of satisfactorily atomizing such fuel and intimately mixing it with air in proportions which are efficiently combustible under the wide range of conditions encountered in ordinary operations as in engine propelled vehicles. Even carburetors using regular grades of gasoline are required to be exceessively complicated and expensive in order to supply the correct and efficient fuel/air mixture for each speed and power requirement encountered in everyday use.

It is the chief purpose of the present invention to provide a carburetor which is capable of forming from diesel fuel, a combustible mixture readily ignited under the range of pressures encountered in engines of the poppet valve type wherein the explosive mixture is drawn into each cylinder by downward movement of the piston, trapped by valve closure, compressed by the upward movement of the piston and exploded by an electric spark as the piston approaches top dead center.

A further purpose is to provide a carburetor of the type aforesaid, which is versatile in its adaptation to the range of engine speeds and loads encountered in ordinary use.

Another purpose and object is to provide a carburetor which because of its versatility as aforesaid, enables a conventional internal combustion engine such as one of the poppet valve type, to burn fuel efficiently within a wide range of speed and load variations and correspondingly reduce pollution without the need for catalytic converters and other special attachments and motor adjustments commonly employed at the present time.

Yet another object is to provide a carburetor as aforesaid, which is relatively simple and inexpensive to fabricate, adjust and adapt either to new engines or to existing ones of the type mentioned.

Other objects and advantages will become apparent to those skilled in the art, after a study of the following detailed description in connection with the accompanying drawing showing a presently preferred model of the invention.

DESCRIPTION OF THE PREFERRED EMBODIMENT

Figure 1:
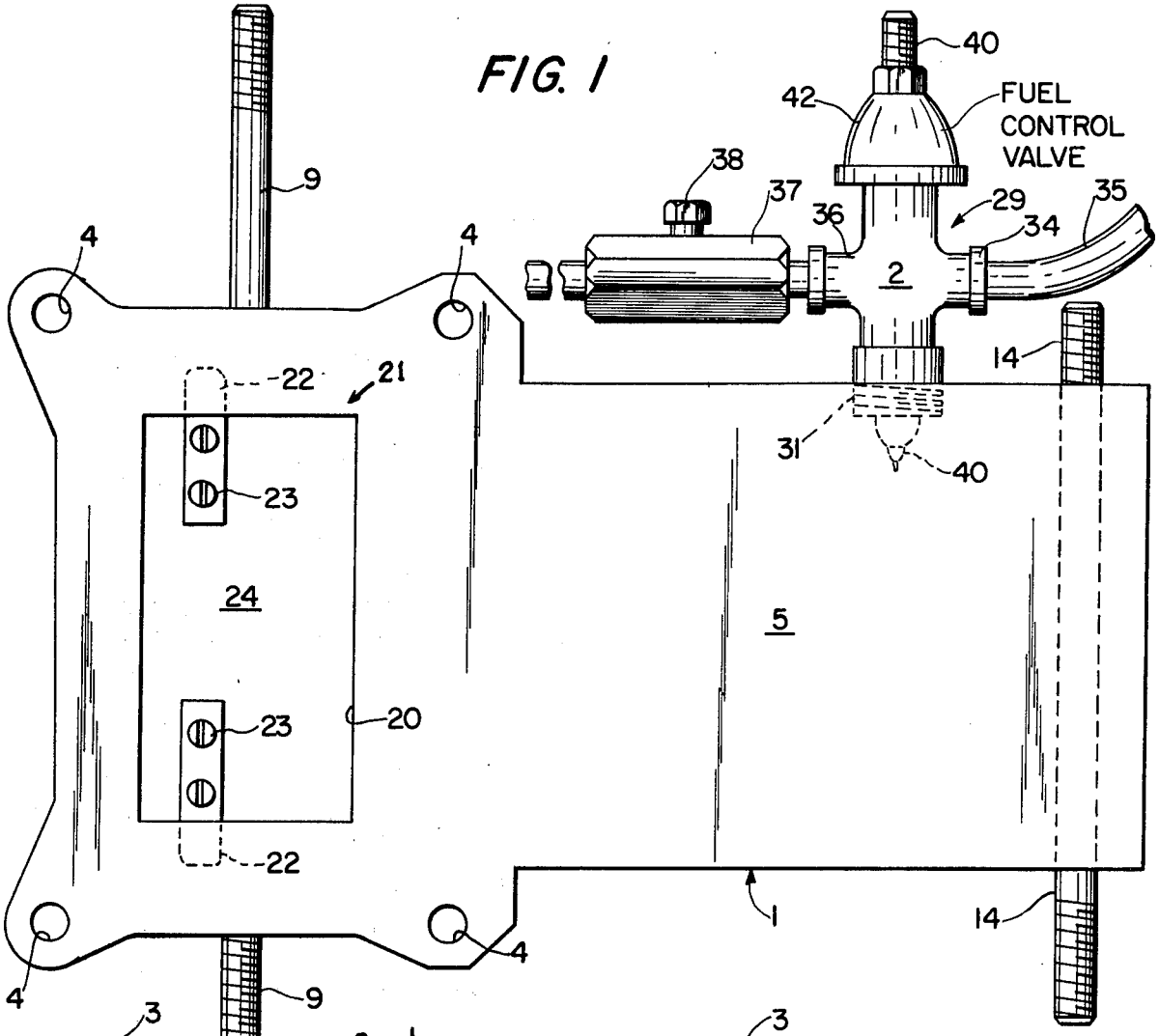
FIG. 1 is a plan or top view of the carburetor.
Figure 3:
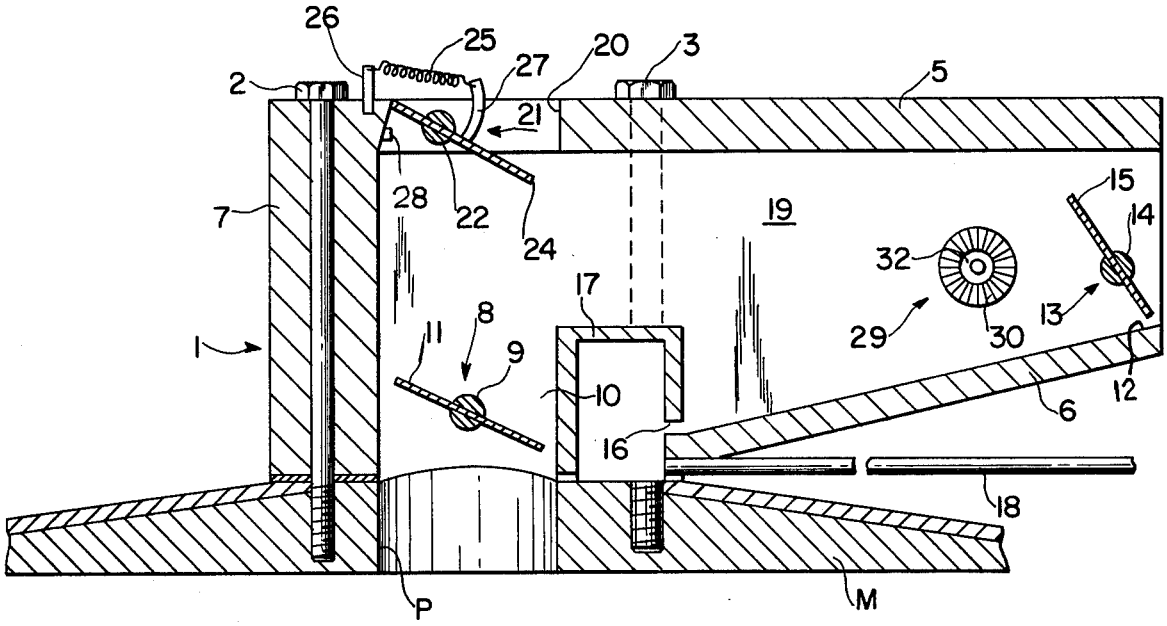
FIG. 3 is a vertical longitudinal section taken in a plane about as identified by line 3 — 3, FIG. 2.

Referring more particularly to FIG. 3, M indicates the intake manifold of an internal combustion engine which may be of the conventional poppet valve and spark ignition type, having an opening or port P to which a carburetor housing generally indicated at 1 is attached as by bolts 2, 3. FIG. 1 shows that holes 4 are provided for four such bolts. The carburetor housing may, as shown, comprise integrally-connected walls including top and bottom walls 5 and 6, and rear wall 7, FIG. 3, together with side walls such as 19.

A butterfly engine-control valve generally identified at 8, FIG. 3, comprises a shaft 9 journaled in axially-aligned bores in the walls forming the throat 10 of the carburetor. Plate 11 fixed to the shaft is shaped to essentialey obturate the flow of explosive vapor through throat 10, when rotated counterclockwise about 22° from the position shown. The shaft extends to the exterior of the housing as in FIG. 1, where, as subsequently described in connection with FIG. 7, it has attached linkage connected with a throttle control lever or accelerator treadle of conventional construction and hence not shown.

The housing wall extends forwardly as indicated at 5 and 6, FIG. 3, to form a forwardly-directed passage closed except at its front end forming air inlet 12 shown as rectangular in form. The effective area of this inlet may be varied by a first damper generally indicated at 13, and comprising a shaft 14 journaled in the walls of the housing and mounting a damper plate 15 fixed thereto and shaped and sized to vary the effective opening of inlet 12 when shaft pivots, as is obvious from FIG. 3. Since the damper plate is fixed to its shaft 14 with its axial center line offset from the axis of the shaft, an increased rate of flow of intake air acts to urge the plate counterclockwise from its fully closed to fully open position wherein the plate is parallel to the inward flow. However, as subsequently explained, this damper is synchronized with control valve 8 to facilite starting and passing.

From FIG. 3 it is noted that bottom wall 6 extends downwardly and rearwardly to weep hole 16 formed in the contiguous wall of a sump 17. Any fuel not vaporized, deposits on wall 6 and flows by gravity to and through hole 16 into the sump from which it is withdrawn by gravity to and through a conduit 18 by pump suction and returned for recirculation, as subsequently described. See also FIG. 4.

Top wall 5 has a second air inlet 20, located over control valve 8. This inlet may be varied in effective area and capacity by a second damper generally identified at 21 and comprising a shaft 22 having its ends freely journaled in aligned bores in the sides of inlet 20 and fixed by screws 23 to damper plate 24. See FIG. 3. As shown, FIG. 3, the axis of the shaft is offset from the parallel center line of the plate so that an air stream entering the inlet tends automatically to pivot the plate and thus augment the effective area of the inlet. However any such thrust on the plate is opposed by a light coil spring 25 having one end anchored to a stud 26 fixed in a bore in housing 1, and its other end attached to a lug 27 fixed with plate 24 so that in a way obvious from inspection of FIG. 3, the plate is continuously urged to obturating position wherein one edge thereof contacts a limit stop 28. As shown upon FIG. 6 the spring may have its tension adjusted as by fixing one end thereof to a threaded post 60 non-rotatably mounted in an aperture in stud 26*a*. A nut 61 is threaded on the post so that turning thereof varies the tension exerted on plate 24.

Figure 5:
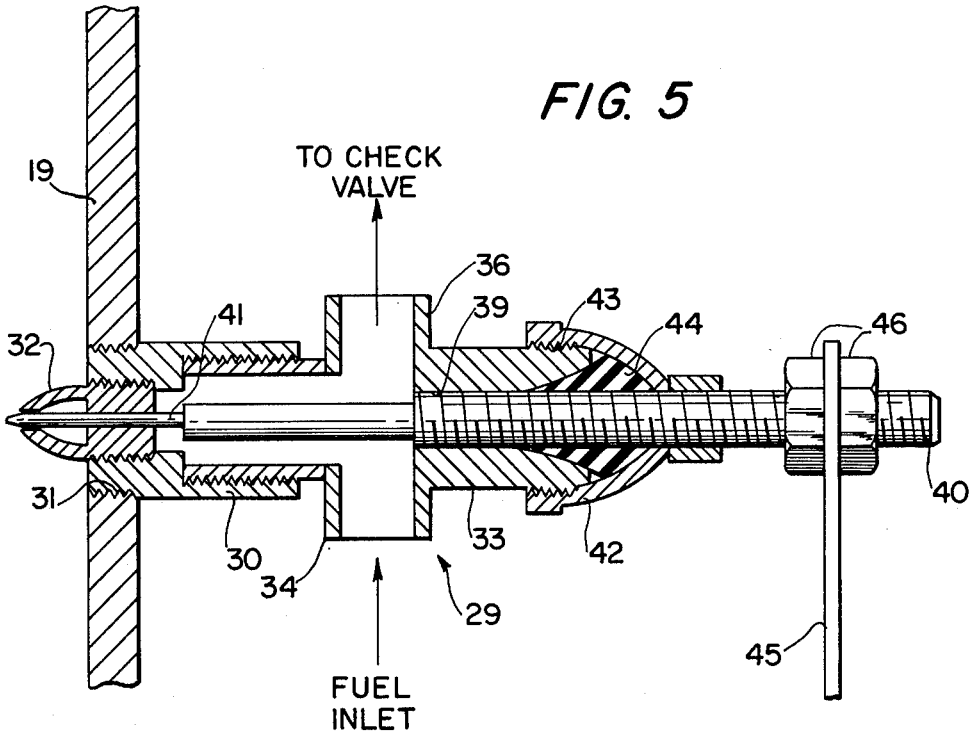
FIG. 5 is an axial longitudinal cross section through the fuel control valve, the scale being enlarged over FIG. 1.

Fuel is atomized by being forced at high pressure through a control valve generally identified at 29. Fuel under pressure of around 300 psi gage is introduced into the intake passage of the carburetor. Referring to FIG. 5, the valve comprises a main fitting 30 threaded into a bore in the side wall 19 of housing 1, as at 31. The fitting is internally and axially bored and threaded to receive a jet former 32. It is also axially counterbored and threaded to accept a valve body 33 having an inlet connection 34 through which fuel is introduced by way of conduit 35, FIG. 1, and a second connection 36 in pressure-tight communication with a safety check valve 37 settable at 38 to release at a selected maximum pressure and which in this case would be above 300 psi.

Valve body 33 is axially bored and threaded at 39 to receive a needle 40 extending forwardly and reduced at 41, with a pointed end disposed in and partially obturating the outlet opening in nozzle 32. It is noted that this nozzle due to its threaded connection with main fitting 30, may be removed and replaced with a selected one of a number of nozzles having differently-sized openings and capacities.

Figure 2:
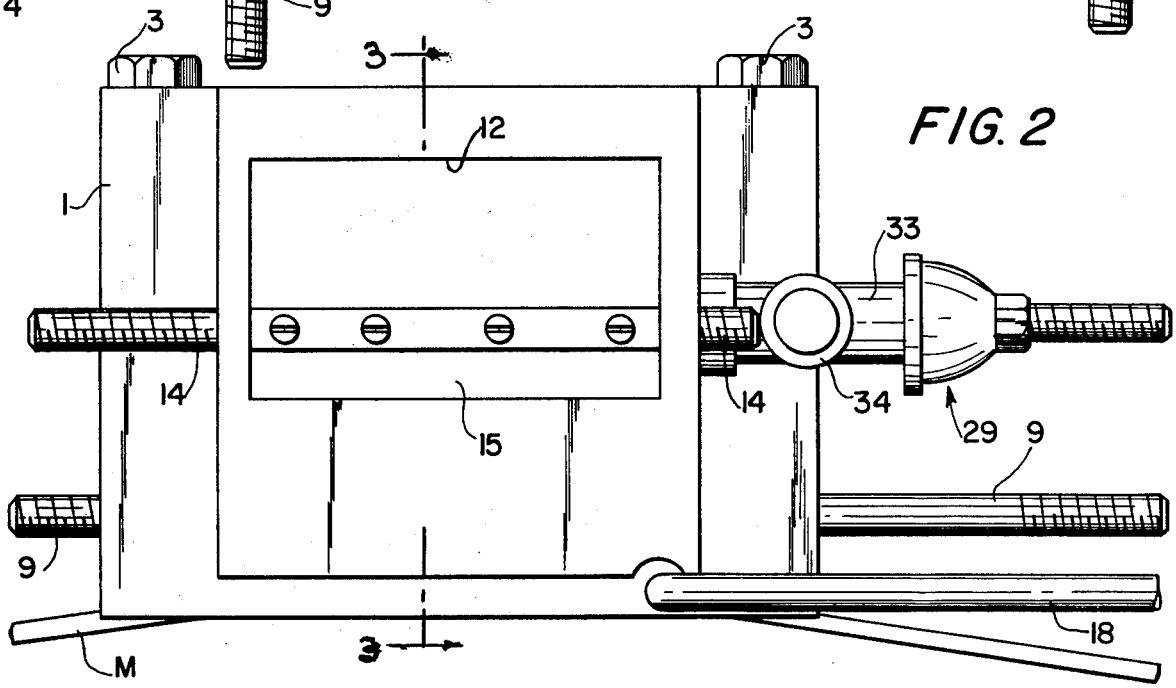
FIG. 2 is a front elevation thereof.

The other end of needle 40 is threaded into bore 39 and extends rearwardly through a sealing cap 42 which is threadedly attached to the exterior threads 43 of valve body 33. A seal 44 of rubber or neoprene is compressed about the needle when cap 42 is turned down, to effect a fluid- and pressure-tight seal. At the same time, as subsequently explained, needle 40 may be rotated to effect axial adjustment in and relatively to fitting 30 to thereby vary the rate of fuel atomization into the carburetor. As shown upon FIGS. 1 to 3, fuel control valve 29 is located downstream of first damper 13 and injects atomized fuel into the air intake passageway.

Referring to FIG. 5, a lever 45 is adjustably fixed to needle 40 by clamping between nuts 46 threaded to the needle. The radially outward end of this lever is pivotally connected with a linkage to the throttle or gas treadle, for manual control of engine speed. In a way clear from the figure, rotation of lever 45 in one direction or the other correspondingly pivots the needle and as the case may be, retracts or advances its pointed end to effect a desired change in rate of fuel feed and engine speed.

Figures 4, 6, 7:
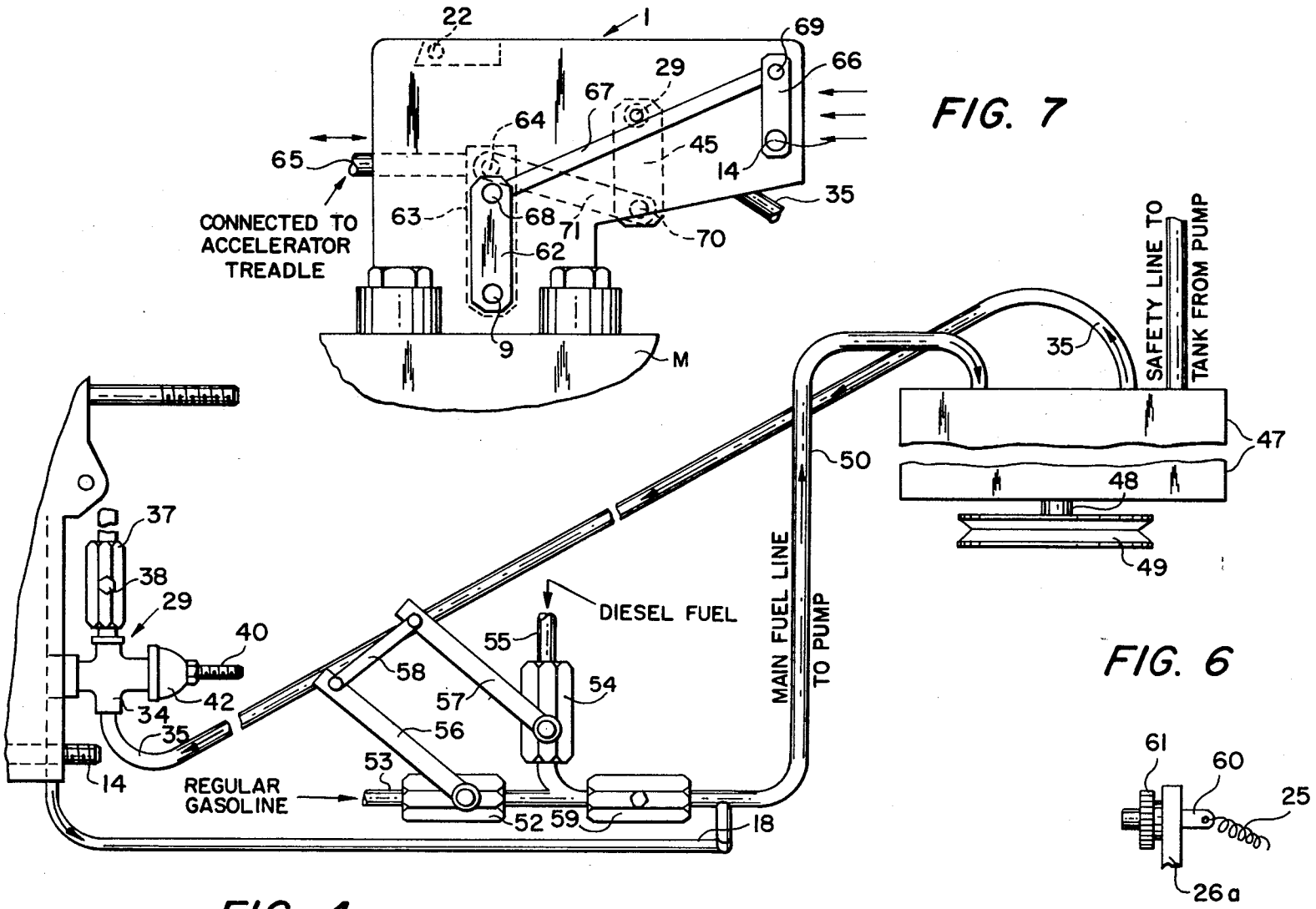
FIG. 4 is a view showing a portion of the carburetor in top plan, about as in FIG. 1, together with the valves, fuel pump and lines interconnecting the parts.
FIG. 6 is a detail view showing means for adjusting the auxiliary damper control spring.
FIG. 7 is a schematic view showing the interconnections between the needle of the fuel control valve, engine control valve, damper plate and rod connected for operation by the accelerator treadle or throttle lever of the engine.

Turning to FIG. 4 in particular, a fuel pump 47 which may be of the rotary geared type, is driven from the engine through shaft 48 and V-belt pulley 49 fixed thereto. The pump draws in fuel over a line 50 and forces it to fuel control valve 29 at high pressure, through delivery line or conduit 35. A first gate valve 52 is supplied from fuel line 53 connected to a tank containing regular gasoline or equivalent fuel. Likewise a second gate valve 54 is supplied from a fuel line 55 communicating with a tank containing diesel fuel. The two gate valves are adjusted between fully open and fully closed positions by respective levers 56 and 57. These levers are connected together at their outer ends by a link 58 so that there is effectively formed a parallelogram wherein the two levers are pivoted or swung equally and oppositely. The connections and arrangements are such that when either valve is fully open, the other is completely closed. Thus a manual control such as a Bowden cable having one end attached to one of the levers or to link 58, may extend to and have its other end disposed in a location convenient to the motor controls, as for instance, by location on the steering column or dashboard of a motor vehicle. By this construction it is possible to effect instantaneous shift from operation of the engine on regular gasoline or equivalent fuel, to diesel fuel. Since it is made after a short warm-up period it is also contemplated that shift to diesel fuel may be effected automatically as by a temperature-sensitive follow-up.

An adjustable fuel gage valve 59, FIG. 4, is located in line 50 downstream from valves 52 and 54 and affords an accurate control of the maximum rate of flow of fuel to the carburetor.

Shaft 9 of butterfly valve 8 and lever 45 of fuel control valve 29 are interconnected by suitable control linkage such that when valve 8 is pivoted to full throttle position, needle 40 is retracted to its maximum flow adjustment. The linkage is also connected with shaft 14 of damper 13 to swing the same to fully open position as may be necessary for starting and added acceleration in passing.

It is important to note that fuel control valve 29 is located downstream from air inlet 12, FIG. 3, and damper 21 is located downstream from valve 29. Thus supplemental air entering through damper 21 picks up less fuel per unit mass of entering air. Since valve 21 is operated by difference in absolute pressure within the carburetor and ambient air, it opens automatically to a degree proportional to such difference and thus, at higher engine speeds and loads, effectively reduces the fuel/air ratio supplied to the engine for those conditions of operation.

FIG. 7 shows a carburetor functionally identical with that of FIG. 1, including the previously-described shafts 9, 14 and 22, and fuel control valve 29. The projecting end of shaft 9 nearest the observer, has lever 62 affixed thereto. Likewise the opposite end of this shaft has a second lever 63 fixed to it. The second lever is shown in dotted lines upon the figure. The radially outward end of lever 63 is pivotally attached as at 64 to the contiguous end of a throttle control rod 65.

Shaft 14 has a lever 66 fixed to its projecting end, noting also FIG. 1. The radially outward ends of levers 62 and 66 are connected to the respective ends of link 67, as by pivots 68 and 69. The connection is such that valve plates 11 and 15 open and close in essential synchronism.

At the side opposite the observer, FIG. 7, the radially outward ends of lever 63 and fuel control valve lever 45 (see also FIG. 5) are pivotally interconnected at 64 and 70, respectively, by link 71. Thus the single pivot 64 interconnects rod 65, lever 63 and link 71. Rod 65 may extend into the driving compartment of the vehicle for actuation in the usual way by an accelerator or foot treadle and return spring, not shown. The connections are such that when rod 65 is axially translated in the direction to open throttle valve 8, lever 45 is turned through an angle to correspondingly axially adjust needle 40 and admit fuel at a proportionally increased rate. At the same time lever 66 is turned to adjust damper plate 15 for an added and proportionally-increased rate of air. It is noted that sump line 18 lets in a limited amount of fuel and also enables the pump to suck in some air which is needed to heat the fuel under compression, as previously explained.

The operation will be generally clear from the foregoing description. Starting with a cold engine the parallelogram linkage 56, 57, 58 will be in the position shown upon FIG. 4 wherein valve 52 is open and 54 is closed so that regular gasoline is drawn by pump 47 from the relatively small tank, not shown, and atomized by valve 29 within the air passageway of the carburetor. After a short warm-up period of perhaps two minutes, the linkage is manually or automatically adjusted so that valves 54 and 52 are respectively opened and closed thus effecting feed of diesel fuel to valve 29.

Air and fuel supplied to the valve at about 300 psi and 200° F. is atomized to a fog-like spray and intimately mixed to form explosive vapor. The mixture passes through engine control valve 8 and after compression in the engine's cylinders is ignited in the usual way by an electric spark. At relatively low speeds and power outputs the pressure differential is insufficient to overcome the tension in spring 25 and hence damper 21 remains essentially closed. At certain speeds depending upon carburetor adjustments, spring tension and other variables, damper 21 opens and thereafter the effective opening thereof will be proportional to the pressure differential between ambient and that in the carburetor throat. Since air entering through this damper is downstream of valve 29, it acts to reduce the fuel/air ratio at higher speeds and thus promotes efficient production of power and minimizes pollution from exhaust gases. Due to the high pressure at which fuel is sprayed into the carburetor, it is heated thereby to about 200° F. Atomization of diesel fuel is therefore very complete and the mixture is burned with high efficiency of power production and a minimum of unconsumed fuel. This is particularly true at speeds wherein damper 21 is open in varying degrees. Raw fuel accumulating in the intake passageway descends onto bottom wall 6, flows into the sump through hole 16 and from thence drawn back to the pump through line 18 and recirculated. The high pressure of about 300 psi is not required while the engine is operating on regular gasoline. This makes for easy starting because the pump is not required to supply fuel at the higher pressure during the warm-up period.

The foregoing is to be taken in an illustrative rather than a limiting sense, as numerous modifications, rearrangements and substitutions of equivalents will become obvious to those skilled in the art, after a study of the disclosure.

I claim:

1. A carburetor comprising, a housing including walls defining a passageway extending from a first air inlet to and through a throat portion adapted for attachment to the intake manifold of an internal combustion engine, an engine control valve mounted in said throat portion and operable to vary the effective opening therethrough, a first damper pivoted in said first air inlet and operable to vary the effective opening thereof, a fuel control valve mounted to one wall of said housing, downstream of said first damper and upstream of said engine control valve, and operable to introduce atomized fuel into said passageway, manually controlled means positively and directly interconnecting said engine control valve and said fuel control valve for conjoint actuation thereof, pump means supplying diesel fuel to said fuel control valve at pressures of the order of 300 psi, there being a second air inlet in and through the walls of said housing and opening into said passageway downstream of said fuel control valve and upstream of said engine control valve, a damper plate having a center line, means mounting said damper plate in said second air inlet for pivoting from a first position obturating the same, to a second position, the pivot axis of said plate being offset from its center line, thus urging said plate to second position by differential absolute pressures within and without said housing, and resilient means connected with said plate and urging the same to first position against the urge of differential pressure.

2. The carburetor of claim 1, and means operable to adjust said resilient means to vary the force urging said plate to its first position.

3. The carburetor of claim 2, means in said housing forming a fuel sump chamber having a floor, a bottom wall of said housing sloping downwardly and rearwardly from said first air inlet and terminating flush with said floor, there being an aperture for flow of liquid fuel from said bottom wall into said chamber, and a return fuel line connecting said chamber with the fuel intake of said pump means.

* * * * *